United States Patent [19]

Jablonski

[11] 4,010,498

[45] Mar. 8, 1977

[54] BATHTUB SAFETY LINER-SPRAY APPARATUS

[75] Inventor: Frank W. Jablonski, Miami Springs, Fla.

[73] Assignee: Lawrence Peska Associates, Inc., New York, N.Y. ; a part interest

[22] Filed: Feb. 6, 1976

[21] Appl. No.: 655,788

[52] U.S. Cl. ..... 4/180; 4/146; 4/185 R; 128/24.1; 128/66

[51] Int. Cl.[2] ..... A47K 3/00; A61H 33/02

[58] Field of Search ..... 4/185 R, 178, 180, 145, 4/146, 181; 128/24.1, 66, 365, 366

[56] References Cited

UNITED STATES PATENTS

| | | | |
|---|---|---|---|
| 1,350,974 | 8/1920 | Kolshorn | 4/180 |
| 3,076,976 | 2/1963 | Bogar | 4/180 |
| 3,086,517 | 4/1963 | Dunkle | 128/66 |
| 3,251,071 | 5/1966 | Wood | 4/180 |
| 3,299,885 | 1/1967 | Wessel | 128/66 |
| 3,579,659 | 5/1971 | Baumann | 4/180 |
| 3,636,944 | 1/1972 | Bryant | 128/24.1 |
| 3,892,000 | 7/1975 | Morse | 4/185 F |
| 3,909,859 | 10/1975 | Harris | 4/185 R |

*Primary Examiner*—Henry K. Artis
*Attorney, Agent, or Firm*—Eugene V. Mandel

[57] ABSTRACT

A bathtub safety liner-spray apparatus that includes padding for comfort and safety and a multiplicity of spray heads that provide a shower effect within the bathtub's cavity.

7 Claims, 3 Drawing Figures

BATHTUB SAFETY LINER-SPRAY APPARATUS

BACKGROUND OF THE INVENTION

This invention relates to liners for bathtubs, and more particularly to a padded bathtub liner including a spray apparatus.

Bathtubs in use today have hard surfaced sides and bottoms. This hard surface becomes uncomfortable after a short length of time to the user especially the elderly and infirm. The surface of conventional bathtubs are enameled or are porcelain, both of which are subject to chipping and scratching from use and cleaning. In addition this type of surface is very slippery when wet and is a bad safety hazard.

The use of a shower necessitates the standing of the user. It is sometimes desirable or necessary in the case of the infirm for the user to recline while bathing. Present methods of filling a bathtub do not provide even distribution of water temperatures.

SUMMARY OF THE INVENTION

Accordingly, it is a primary object of the present invention to provide a bathtub safety liner-spray apparatus that includes a resilient layer for safety and comfort.

It is a further object of the present invention to provide a bathtub safety liner-spray apparatus that includes a water and soap resilient layer that is textured to prevent the user from slipping.

A still further object of the present invention is to provide means for the even distribution of water temperature when new water is introduced to the water already in the tub.

Another object of the present invention is to provide a bathtub safety liner-spray apparatus including a repellent layer that is colored and therefore is a decorative enhancement to the bathroom's decor.

These objects, as well as further objects and advantages of the present invention will become readily apparent after reading the description of a non-limiting illustrative embodiment and the accompanying drawings.

A bathtub safety liner-spray apparatus including a primary layer, a resilient layer bonded to the primary layer, a water and soap repellent liner bonded to the resilient layer and having ends of a sufficient length to overlap a conventional bathtub, a network of tubing within the resilient layer, a multiplicity of water jets inserted through the water and soap repellent liner and coupled to the tubing network, and a coupling member connected to the tubing network and adapted to cooperate with a conventional bathtub faucet.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
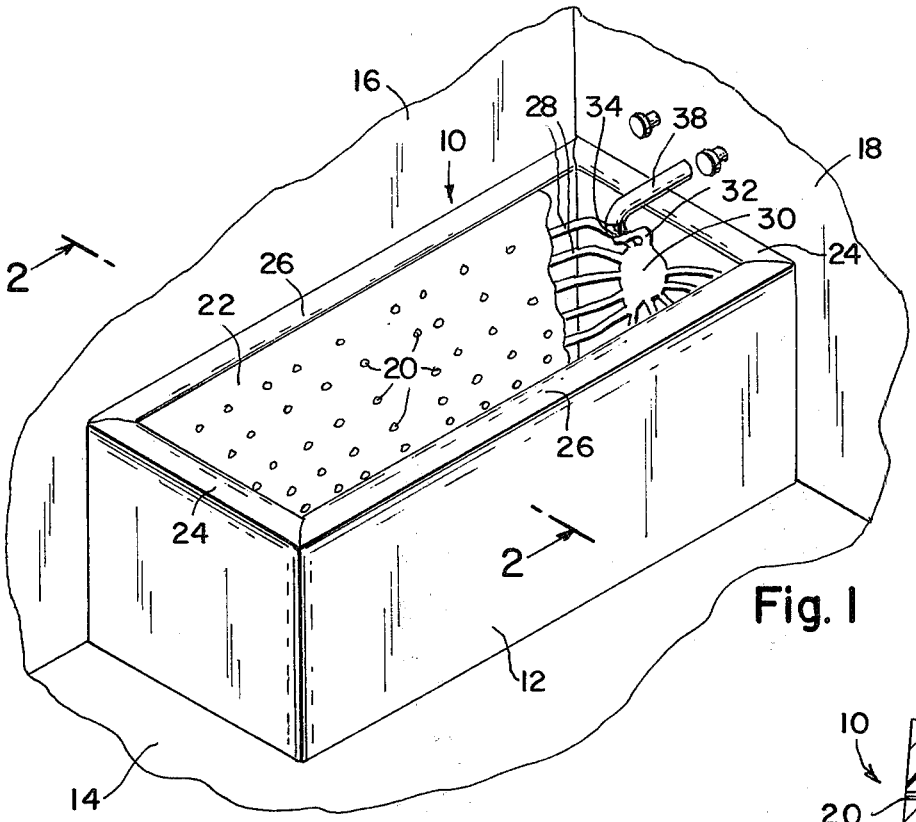
FIG. 1 is a pictorial representation of the preferred embodiment of the present invention installed in a conventional bathtub.

Referring now to the figures, and more particularly to the preferred embodiment illustrated in FIG. 1 showing a bathtub safety liner-spray apparatus 10 installed in a bathtub 12 which rests on a floor 14 and adjacent to the walls 16, 18. A multiplicity of water jets 20 are affixed within a soap and water repellent liner 22. The liner 22 is provided with flaps 24, 26 which extend over the edges of bathtub 12. A network of tubing 28 under the liner 22 is joined at a junction connector 30. The connector 30 is affixed to one end of a tube 32. The other end of tube 32 is affixed to a coupling member 34 which is adapted to cooperate with a bathtub faucet 38 mounted on wall 18.

Figure 2:
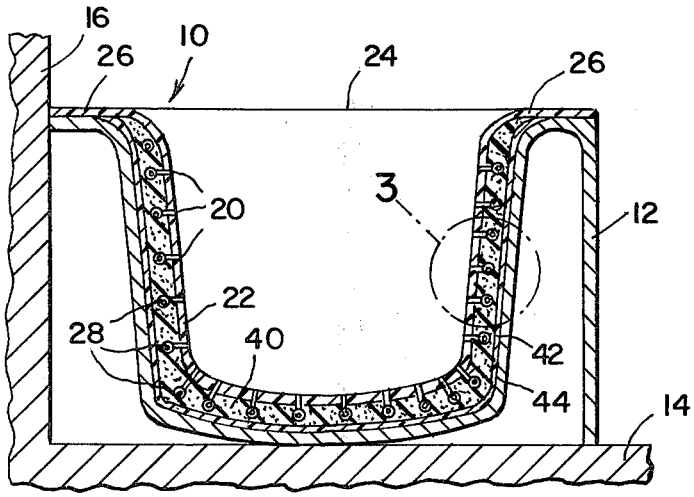
FIG. 2 is a cross sectional view of the preferred embodiment of the present invention taken substantially along the line 2—2 of FIG. 1.

FIG. 2 is an enlarged cross sectional view of the apparatus 10 taken substantially along line 2—2 in FIG. 1.

Figure 3:
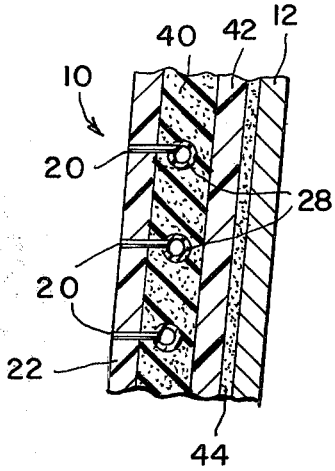
FIG. 3 is an enlarged partial cross sectional view of the preferred embodiment of the present invention taken substantially inside section 3 of FIG. 2.

FIG. 3 is an enlarged partial cross sectional view taken substantially within section 3 of FIG. 2. The liner 22 is bonded to a resilient layer 40. The layer 40 is bonded to a primary layer 42 that is preferrably affixed to the bathtub 12 by a layer of silicone glue 44. The tubing network 28 is embedded in the resilient layer 40 and the water jets 20 are affixed to the layer 22 and coupled to the tubing network 28. The layer 20 is preferrably textured and decoratively colored. The primary layer 42 is preferrably constructed of molded vinyl and the resilient layer 40 of foam rubber. The tubing network 28 is preferrably constructed of neoprene.

In operation, the texturing on the layer 20 serves as an antislip device. The resilient layer 40 provides padding for comfort and safety. When coupling 34 is attached to the faucet 38 and the water is turned on a fine spray of water is released from the jets 20. This permits the user to "shower" in a reclining position. If the bathtub 12 has already been filled and more water is desired it enters the bathtub from all the jets 20 permitting an even distribution of temperature instead of hot or cold spots caused by water directly from the faucet.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A bathtub safety liner spray apparatus comprising:

a. a primary layer;

b. a resilient layer bonded to said primary layer;

c. a water and soap repellent liner bonded to said resilient layer and having edges of sufficient length to overlap a conventional bathtub;

d. a network of tubing within said resilient layer;

e. a multiplicity of water jets inserted through said water and soap repellent liner and coupled to said tubing network; and f. a coupling member connector to said tubing network and adapted to cooperate with a conventional bathtub faucet.

2. A bathtub safety liner and spray apparatus according to claim 1, wherein said primary layer is constructed of molded vinyl.

3. A bathtub safety liner and spray apparatus according to claim 1, wherein said resilient liner is constructed of foam rubber.

4. A bathtub safety liner and spray apparatus according to claim 1, wherein said repellent layer is constructed of soft vinyl.

5. A bathtub safety liner and spray apparatus according to claim 1, wherein said soft vinyl is textured.

6. A bathtub safety liner and spray apparatus according to claim 1, wherein said network of tubing is constructed of neoprene.

7. A bathtub safety liner and spray apparatus according to claim 1, wherein said repellent layer is colored as a decorative enhancement to bathroom decor.

* * * * *